US005120214A

United States Patent [19]

West et al.

[11] Patent Number: 5,120,214

[45] Date of Patent: Jun. 9, 1992

[54] ACOUSTICAL BURNER CONTROL SYSTEM AND METHOD

[75] Inventors: John S. West, Camp Hill; David A. Shefet, Harrisburg; John M. Carlyle, Yardley, all of Pa.

[73] Assignee: Control Techtronics, Inc., Pa.

[21] Appl. No.: 649,258

[22] Filed: Jan. 31, 1991

Related U.S. Application Data

[63] Continuation of Ser. No. 435,948, Nov. 13, 1989, abandoned.

[51] Int. Cl.[5] ..... F23N 5/16

[52] U.S. Cl. ..... 431/12; 431/75; 431/76; 431/78

[58] Field of Search ..... 431/18, 12, 75, 76, 431/78; 236/1 A, 15 BA; 340/577

[56] References Cited

U.S. PATENT DOCUMENTS

| | | | |
|---|---|---|---|
| 2,767,783 | 10/1956 | Rowell et al. | 431/75 X |
| 2,966,209 | 12/1960 | Pegrum | 431/75 X |
| 3,369,749 | 2/1968 | Siegmund et al. | 431/12 |
| 3,586,468 | 6/1971 | Sims | 431/75 X |
| 3,635,018 | 1/1972 | De Corso et al. . | |
| 3,811,816 | 5/1974 | Whitman . | |
| 4,280,183 | 7/1981 | Santi . | |
| 4,477,245 | 10/1984 | Giachino et al. | 431/75 X |
| 4,538,979 | 9/1985 | Bertrand . | |
| 4,626,191 | 12/1986 | Bertrand . | |
| 4,645,450 | 2/1987 | West . | |
| 4,679,435 | 7/1987 | Finfinger et al. . | |
| 4,742,783 | 5/1988 | La Spisa et al. | 431/12 X |

FOREIGN PATENT DOCUMENTS

| | | |
|---|---|---|
| 817116 | 3/1961 | U.S.S.R. . |
| 1495015 | 12/1977 | United Kingdom . |
| 2042221 | 4/1979 | United Kingdom . |

OTHER PUBLICATIONS

Document entitled "Technical Support Package on Acoustic Emissions Reveal Combustion Conditions" for summer 1983, NASA Technical Brief vol. 7, No. 4, Item No. 14.

*Primary Examiner*—Carl D. Price

*Attorney, Agent, or Firm*—Sixbey, Friedman, Leedom & Ferguson

[57] ABSTRACT

An acoustically operated burner control system for optimally controlling a flow of air and fuel into a flame producing combustion burner throughout a range of firing rates is disclosed. The system includes separate valve assemblies for modulating the flow of air and fuel into a burner, a microphone for generating an electrical signal indicative of the intensity of all sounds generated by the combustion flame having a frequency in excess of about 10 Khz, and a controller including a programmable microprocessor electrically connected to both the air and fuel valve assemblies and the microphone. The system further includes a wave guide for remotely acoustically coupling the microphone to the combustion flame in order to isolate the microphone from both heat and corrosive combustion products. Prior to the operation of the system, empirically-derived sound intensities associated with optimum stoichiometric combustion and minimum pollution are entered into the memory of the microprocessor. During operation, the microprocessor equates the sound intensity sensed by the microphone with the optimum sound intensity in its memory by regulating the position of the air and fuel valve assemblies.

30 Claims, 3 Drawing Sheets

ACOUSTICAL BURNER CONTROL SYSTEM AND METHOD

This application is a continuation of Ser. No. 07/435,948, filed Nov. 13, 1989, now abandoned.

BACKGROUND OF THE INVENTION

This invention generally relates to feedback operated burner controls, and is concerned with an acoustical burner control system and method which operates by measuring the aggregate intensity of the sounds generated by the combustion flame having a frequency of over 30 Khz.

Burner controls that utilize a feedback mechanism which constantly monitors one or more parameters indicative of the combustion products generated by the burner are known in the prior art. Such systems generally include electrically operated valve assemblies for modulating a flow of air and fuel to a burner which is disposed within a furnace housing. In one of the most popular prior art systems in use today, a zirconium oxide cell is placed within the furnace housing in order to compare the composition of the flue gas to that of standard air. The zirconium oxide cell generates an electrical signal indicative of the percentage of oxygen in the flue gas, and transmits this signal to the input of a microprocessor. The output of the microprocessor is in turn connected to the electrically operated valve assemblies which regulate the flow of air and fuel to the burner. At each point along the firing range of the burner, the microprocessor is programmed to modulate the air and fuel-controlling valve assemblies so that the fuel combusts in an optimal manner. For the purposes of this application, "optimum" combustion denotes combustion that achieves one or more of the goals of the maximum stoichiometric fuel efficiency, maximum heat generation per unit of fuel, and the minimum generation of pollutants such as $NO_x$ and CO.

While zirconium oxide cells have proven to be effective for their intended purpose, the applicant has noted a number of performance characteristics of these cells which could stand improvement. For example, these cells are fragile, and require great care during the installation procedure to avoid breakage. This same fragility also renders these cells subject to inadvertent breakage when routine maintenance operations are performed from time to time over the lifetime of the burner. Additionally, because these cells must be located in the interior of the furnace housing in order to analyze the products of combustion of the burner, they are constantly exposed to corrosive heat and gases and ash residues which can corrode, clog, and coat the outer surfaces of the cell, thereby rendering it either inaccurate, or even inoperative. Finally, these cells are often slow to respond to significant changes in the composition of the flue gases which they monitor, which not only impairs the ability of the microprocessor connected to the cell to maintain an optimum flow of air and fuel to the burner at all times during the operation of the burner, but also prevents the microprocessor from quickly recognizing the existence of an emergency condition within the furnace which may require immediate burner shut-down and the triggering of an alarm circuit.

Acoustically operated burner control systems are also known in the prior art. Like the previously described zirconium cell type control systems, such acoustical systems are operated on the basis of feedback from the conditions existing around the combustion flame of the burner, which advantageously allows them to respond to a real-time, monitored condition within the furnace housing to maintain an optimum combustion. Unfortunately, such systems suffer from a number of drawbacks which has thus far effectively obstructed the use and widespread commercialization of such systems. One of the largest of these obstacles has been the inability of persons in the art to find a universally accurate and useful relationship between the acoustical characteristics of the sound generated within a furnace housing and optimum combustion. While studies have been conducted which purport to demonstrate a measurable and usable relationship between the ratios of the intensities of sounds generated at specific frequencies and optimum combustion, the applicant has found that these relationships are not consistently reproducible, and may not apply at all to different furnaces. These inconsistencies make it very difficult to retrofit an acoustical burner control system onto a furnace already in operation, as the non-universality of the acoustical relationships found in the prior art make it necessary to empirically re-derive these relationships for every specific model of furnace, assuming they exist at all. Worse yet, the applicant has found that these ratio frequency relationships do not remain constant throughout the entire firing range of the burner. Hence, if one were to attempt to use the acoustical relationships disclosed in the prior art to optimally control a burner throughout its entire firing range, it would be necessary to attempt to empirically find exactly what these relationships might be at each point along the firing range, making the initial set up of the system difficult, if not impossible in view of the fact that there may not be any usable relationship at all at certain points in the firing range. Finally, because these prior art approaches mainly rely upon sounds generated as a result of resonance between the combustion flame and the chamber defined by the furnace housing, the microphones used in such prior art system must be placed in the interior of the furnace housings, which in turn exposes them to large amounts of heat and corrosive combustion products. Just like the zirconium cells previously discussed, the exposure of these microphones to such heat, combustion products and flue ashes can cause their readings to become either inaccurate or entirely inoperative. In some prior art systems, a protective jacket is provided around the microphone so that water can constantly circulate around it, thereby protecting it from the heat generated by the furnace. However, the provision of such a jacket and the need for a mechanism to constantly recirculate water through it is an expensive and unwieldy solution to the problem of microphone durability in the hostile environment present within the furnace housing.

Clearly, what is needed is an acoustical burner control system which is effective and accurate in optimizing all aspects of combustion for a variety of different burners and furnaces, and over the entire firing range of each such burner. Ideally, the system should be easy to provide in new burners, and easy to retrofit in old burners that utilize some sort of prior art burner control. The acoustical system should also be easy to set up and calibrate, and should not require the empirical derivation of a relationship between an acoustical property and optimum burning over a large number of points of the firing range of the burner. Further, such an acoustical burner control system should respond quickly to changes in the combustion characteristics of the burner, and be formed from relatively durable, maintenance-free and long-lived components. It would further be desirable if the microphone could somehow be removed from the hostile environment within the furnace to increase its reliability and durability. Finally, the acoustical control system should be able to immediately sense when either a non-stoichiometric combustion condition exists, or excessive $NO_x$ or other pollutants are being generated by the combustion flame.

SUMMARY OF THE INVENTION

Generally speaking, the invention is an acoustically operated burner control system and method for optimally controlling a flow of air and fuel into a flame producing combustion burner throughout a range of firing rates which overcomes or at least ameliorates the shortcomings associated with the prior art. The system of the invention may comprise first and second valve assemblies for modulating the flow of air and fuel into the burner, a microphone for generating an electrical signal indicative of the aggregate intensity of the sound generated within the envelope of the combustion flame that is above 10 Khz in frequency, and a microprocessor controller operatively connected to the first and second valve assemblies and electrically connected to the microphone for maintaining the aggregate sound intensity generated by the combustion flame at a pre-selected level associated with optimality at each point within the range of burner firing rates. Alternatively, the system may comprise merely the aforementioned microphone, and a monitoring mechanism for monitoring the aggregate sound intensity of the microphone so that it can be compared to a preselected sound intensity associated with optimality. The monitoring mechanism may include a chart recorder, a comparison circuit for continuously comparing the sound intensity of the microphone with the pre-selected sound intensity, and an alarm circuit for generating an alarm signal when these sound intensities are not equal so that the flow rate of fuel and air into the burner may be manually re-adjusted to achieve optimality.

The bandwidth of the microphone may include only those acoustical frequencies greater than 10 Khz, and preferably, greater than 20 Khz, and even more preferably greater than 30 Khz. For this purpose, a microphone whose maximum sensitivity is centered on 32 Khz may be used.

The system may further include an acoustical wave guide for remotely coupling the microphone to the flame envelope while at the same time isolating the microphone from the heat generated by the flame. Since the system is not in any way dependent upon any acoustical interactions between the combustion flame and the furnace housing that surrounds it, the microphone may advantageously be located outside of the furnace housing. In such a configuration, the acoustical wave guide coupling the microphone with the sound generated by the flame isolates the microphone not only from the heat of the flame, but also from the combustion products generated by the flame, thereby greatly lengthening its life expectancy. In the preferred embodiment, a 0.50 inch diameter rod of a ceramic material such as aluminum oxide may be used as the wave guide.

The system may also include a portable analyzer probe for determining the optimal stoichiometric and pollution minimizing settings of these valve assemblies over the entire firing range of the burner prior to the operation of the burner. Finally, the microprocessor controller of the system preferably includes a memory into which the empirically-derived optimum air and fuel valve assembly settings may be entered for sample points along the firing range of the burner, and appropriate software for interpolating these sample points into a curve.

In the method of the invention, the optimum air and fuel valve assembly settings are empirically determined by means of the aforementioned analyzer probe for between six and eight points along the firing range of the burner. This may be done by initially operating the burner in an excess air mode at a particular point along the firing range of the burner, and then gradually closing the air valve assembly until the analyzer probe senses minimum excess $O_2$ and minimum acceptable CO, which would indicate that stoichiometric optimality has been obtained. Next, the valve assemblies associated with $NO_x$ or other pollution minimization are adjusted to achieve further minimum pollution emission. For example, in a burner having a flue gas recirculation mechanism that quenches the burner flame in order to lower its temperature and to lower $NO_x$ generation the valve assembly that controls the flue gas recirculation flow is adjusted until the $NO_x$ reading sensed by the analyzer probe indicates that minimum $NO_x$ generation has been achieved. The settings of the valve assemblies for fuel flow, air flow and flue gas recirculation flow are all noted, along with the aggregate intensity of all sounds over 10 Khz generated by the burner flame and these settings and associated sound intensity are all entered into the memory of the microprocessor. This same method step is repeated six to eight times across the entire firing range of the burner. Next, the interpolation software of the microprocessor is actuated to generate an optimality curve across the entire firing range of the burner. When the burner is operated at a selected point along its firing range, the microprocessor constantly adjusts the positions of the air and fuel valve assemblies in such a manner as to maintain the aggregate intensity of all sounds having a frequency greater than 10 Khz at the optimal sound level associated with the selected point along the firing range.

The acoustical burner control system of the invention is readily adaptable to a broad variety of different types of burners, and is easy to calibrate and to retrofit onto an existing furnace in view of the near linear nature of the optimum sound intensities over the firing range of the burner. Moreover, the exterior positioning of the microphone greatly facilitates the installation and access of the microphone onto an existing system, and further facilitates microphone longevity by insulating it from the heat and combustion by-products present within the furnace housing. Finally, the system provides a simple and inexpensive way to achieve not only stoichiometric combustion, but combustion that produces minimum amounts of pollutants such as $NO_x$ as well.

BRIEF DESCRIPTION OF THE SEVERAL FIGURES

Figure 4:
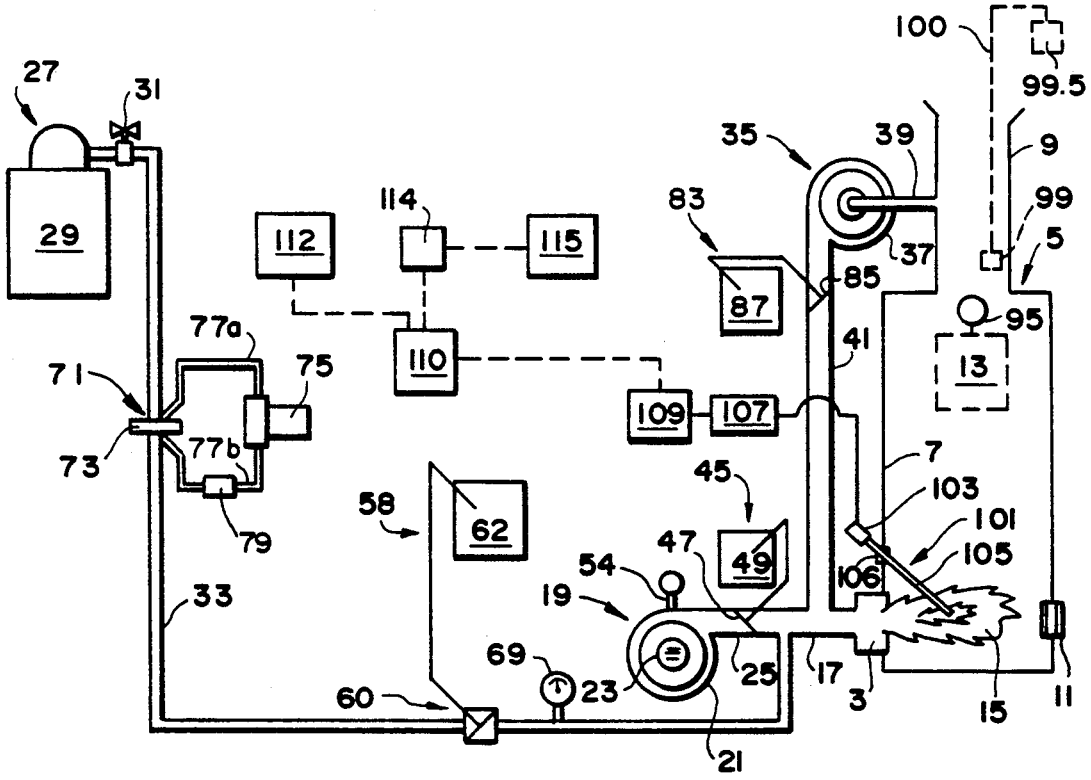
Figure 3:
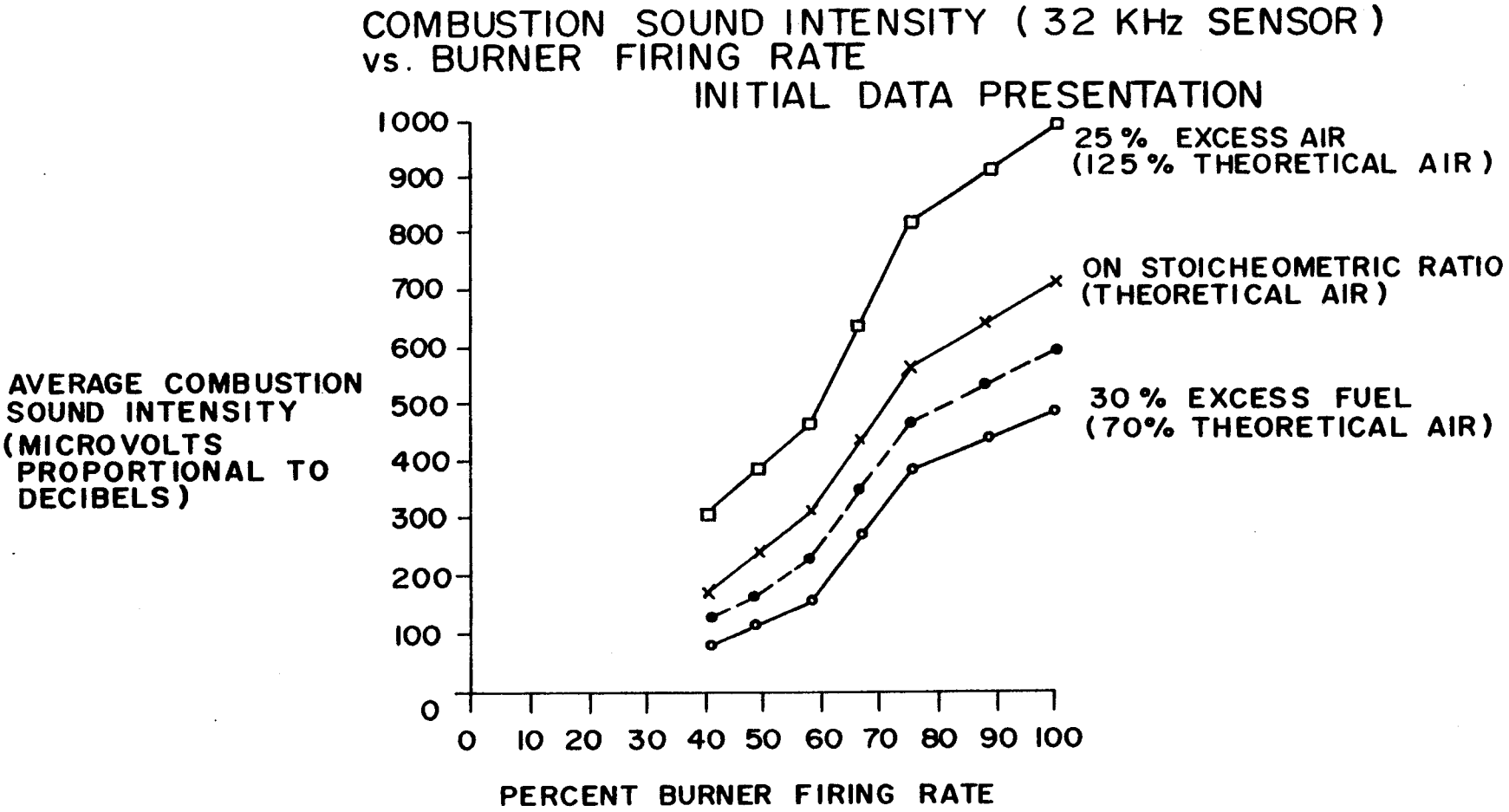

FIG. 3 is a graph which plots the average combustion sound intensity over the burner firing rate for an excess air to fuel ratio, a stoichiometric ratio, and an excess fuel to air ratio, as sensed by a 32 KHz microphone; and FIG. 4 is a schematic diagram of a manually operated embodiment of the control system of the invention wherein the output of the system microphone is connected to a simple monitoring mechanism that informs the system operator when the air and fuel valve assemblies need re-adjustment.

DETAILED DESCRIPTION OF THE PREFERRED EMBODIMENT

Figure 1:
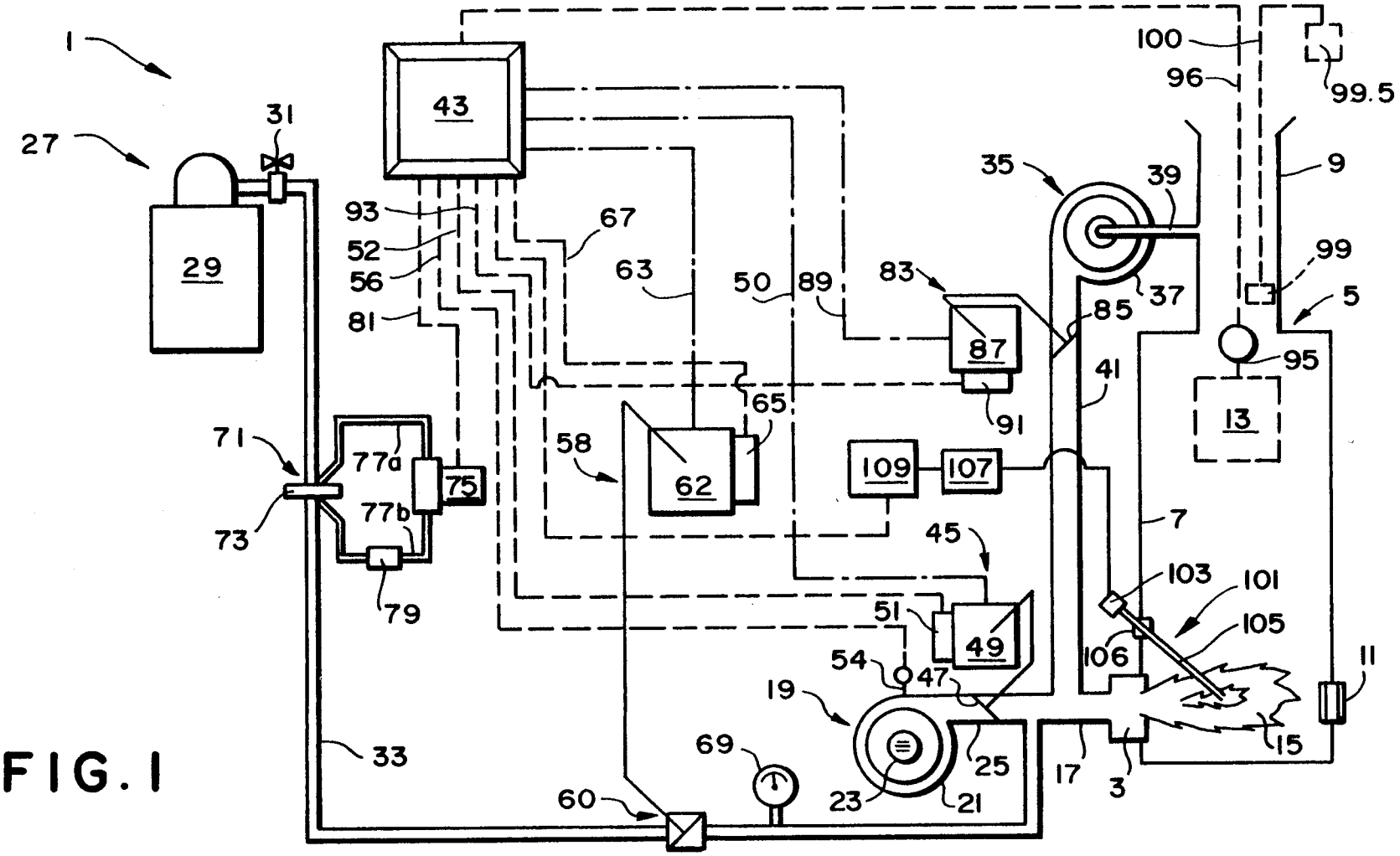
FIG. 1 is a schematic diagram of an automatically operated embodiment of the burner control system of the invention as it would appear assembled onto a combustion burner in a furnace assembly having motor controlled air and fuel valve assemblies.

With reference now to FIG. 1, the burner control system 1 of the invention is particularly well adapted for optimally controlling the combustion of fuel and air in a combustion burner 3 mounted within a furnace assembly 5. The burner 3 may be any one of a number of known and commercially available burner units having a variable firing rate. While a burner 3 mounted in a furnace assembly 5 having a flue gas recirculation mechanism for minimizing $NO_x$ generation is used in this particular example, the invention may be used with burners having other types of $NO_x$ minimizing subsystems as well. The furnace assembly 5 includes a housing 7 with a lower portion that contains the burner 3 and an upper portion that includes a flue 9. A peep site 11 is mounted in one of the walls of the housing 7 to assist the system operator in determining whether or not the burner 3 is operating properly. The furnace assembly 5 used to heat a boiler 13 in this example that generates steam for use in a building heating system.

The outlet of the combustion burner 3 generates a flame 15 which is confined within the walls of the housing 7, while the inlet of the burner is connected to an inlet conduit 17 which receives not only a mixture of air and gaseous fuel, but also recirculated flue gases which help to lower the maximum temperatures of combustion within the housing 7 and therefore to lower $NO_x$ generation. Inlet conduit 17 is directly connected to an air source 19 formed from a blower 21 having an inlet opening 23 for receiving ambient air, and an outlet conduit 25 for directing a flow of air into conduit 17. Fuel source 27 is also connected to the conduit 17. The fuel source 27 is formed from a tank 29 of fuel, which may be either gaseous or liquid, a shut-off valve 31 downstream of the fuel tank 29 which allows the furnace assembly 5 to be shut-down for maintenance or repairs, and an outlet conduit 33 which is connected to the burner inlet conduit 17 by means of a T-joint as shown. Finally, conduit 17 is connected to recirculating flue gas source 35 which includes a blower 37 having an inlet conduit 39 connected to the flue 9, and an outlet conduit 41 which joins the blower inlet conduit 17 at another T-joint as shown.

In the preferred embodiment, the burner control system 1 of the invention includes a microprocessor controller 43 which, as will be explained in more detail hereinafter, controls the flow of air, fuel, and recirculated flue gases into the inlet conduit 17 of the combustion burner 3 in order to obtain optimum combustion. The microprocessor controller 43 is preferably a "MasterMind"-type combustion controller manufactured by Control Techtronics located in Harrisburg, Pa.

The burner control system further includes an air control valve assembly 45 for controlling the amount of air that flows into the inlet conduit 17 of the combustion burner 3. The air control valve assembly 45 includes a butterfly valve 47 that is pivotally mounted within the outlet conduit 25 of the air source 19, and a motor 49 for pivoting the butterfly valve 47 into a more opened or closed position within the conduit 25. Motor 49 may be, for example, a model EA53 reversible DC motor manufactured by Barber-Colman located in Rockford, Ill. Such motors include a control circuit for regulating both the voltage and the polarity of the current conducted through the motor. This control circuit is in turn electrically connected to the output of the microprocessor controller 43 through control cable 50. The air control valve assembly 45 further includes a slide wire position indicator 51 connected to the motor 49 which indicates the position of the armature of the motor 49 and hence the angle at which the butterfly valve 47 is pivoted within the conduit 25. The slide wire position indicator is a form of a variable resistor, and may be, for example, a model Q181 slide wire manufactured by Honeywell located in Fort Washington, Pa. The output of the slide wire position indicator 51 is electrically connected to the input of the microprocessor 43 by means of output cable 52. In addition to the air control valve assembly 45, the air source 19 is also provided with a thermocouple 54 for measuring the temperature of the ambient atmosphere. In the preferred embodiment, the thermocouple 54 may be a model number M116-2000-80002-09 manufactured by Cleveland Electric Labs located in Twinsburg, Ohio, and the output of this thermocouple 54 is electrically connected to the input of the micro-processor controller 43 by means of cable 56 as shown. The data that the thermocouple 54 provides to the microprocessor controller 43 is necessary for the microprocessor 43 to compute the optimum air flow required by the combustion burner 3, as the density of air and hence the amount of oxygen contained per volume of air varies with the ambient temperature.

The burner control system 1 also includes a fuel control valve assembly 58. Fuel control valve assembly 58 includes a motor operated butterfly valve 60 mounted within the fuel outlet conduit 33 which may be a model BVA valve manufactured by the Eclipse Corporation located in Rockford, Ill. Fuel control valve assembly 58 also includes a reversible, DC motor 62 for turning the butterfly valve 60 that is provided with a control circuit for regulating the voltage and polarity of electric current conducted through the motor 62, and a motor control cable 63 which connects the control circuit of the motor 62 to the output of the microprocessor controller 43. The fuel control valve assembly 58 includes a slide wire position indicator 65 mounted on to the motor 62 as shown. Both the motor 62 and slide wire position indicator 65 may be the same commercially available type of motor and position indicator described with respect to the air control valve assembly 45. As was the case with the slide wire position indicator 51 used in the air control valve assembly 45, a position output cable 67 electrically connects the slide wire position indicator 65 with the input of the microprocessor controller 43. Downstream of the gate valve 60 of the fuel control valve assembly 58 is a pressure gauge 69. This gauge 69 assists the system operator in the initial set-up of the system 1, and further helps maintenance personnel determine whether or not the system 1 is functioning properly. Upstream of the butterfly valve 60 of the fuel control valve assembly 58 is a flowmeter 71 for accurately determining the volume of gaseous fuel from fuel tank 29 that flows into the inlet conduit 17 of the burner 3. This flowmeter 71 includes an orifice plate 73 which, in the preferred embodiment, is a model FOM orifice plate manufactured by the Eclipse Corporation located in Rockford, Ill. The flowmeter 71 further includes a differential pressure sensor 75 that is connected upstream and downstream from the orifice plate 73 by means of meter conduit 77*a* and 77*b*. A snubber is provided in meter conduit 77*b* for damping out any pulsations in the flow of gaseous fuel flowing through fuel outlet conduit 33 so that the output of the flow meter 71 is indicative of the average flow rate of gaseous fuel through the conduit 33. In the preferred embodiment, the differential pressure sensor 75 is a model P3081-SWD assembly manufactured by the Schaevitz Engineering Company located in Pennsauken, N.J. The output of the differential pressure sensor 75 is related to the input of the microprocessor through output cable 81.

The control system 1 also includes a flue gas control valve assembly 83. Like the previously described air control valve assembly 45, the flue gas control valve assembly 83 is provided with a butterfly valve 85 which is mounted in outlet conduit 41, and a reversible, DC motor 87 for controlling the position of the butterfly valve 85 within the conduit 41. The motor 87 includes a control circuit for regulating the voltage and the polarity of the electric current conducted through its respective motor. This control circuit is electrically connected to the output of the microprocessor 43 by way of motor control cable 89. A slide wire position indicator 91 is connected on to the motor 87 for generating an electrical signal indicative of the position of the armature of the motor, and hence the position of the butterfly valve 85 within the outlet conduit 41. Information generated by the slide wire position indicator 89 is transmitted to the input of the microprocessor by means of position output cable 93.

A pressure sensor 95 is thermally connected to the steam boiler 13 for monitoring the temperature of the steam heated by the furnace assembly 5. In operation, this pressure will vary depending upon the demand placed upon the steam boiler 13 in heating the aforementioned building. The pressure sensed by the sensor 95 is relayed to the input of the microprocessor controller 43 by means of cable 96. Pressure sensor 95 is preferably a model P-3061 sensor manufactured by The Schaevitz Engineering Company located in Pennsauken, N.J. Still another component included within the control system 1 is an analyzer probe 99 which is shown in phantom since the probe 99 is used only for the initial setting-up of the system 1. This probe 99 is detachably mountable to the flue 9 of the furnace assembly 5, and generates an electrical signal indicative of the amount of free oxygen and pollutants present in the flue gases. This signal is transmitted to the input of the probe microprocessor 99.5 by way of cable 100. Analyzer probe 99 may be any one of a number of commercially available oxygen probes, such as a model 2000 portable analyzer manufactured by Enerac located in Long Island, N.Y.

Figure 2:
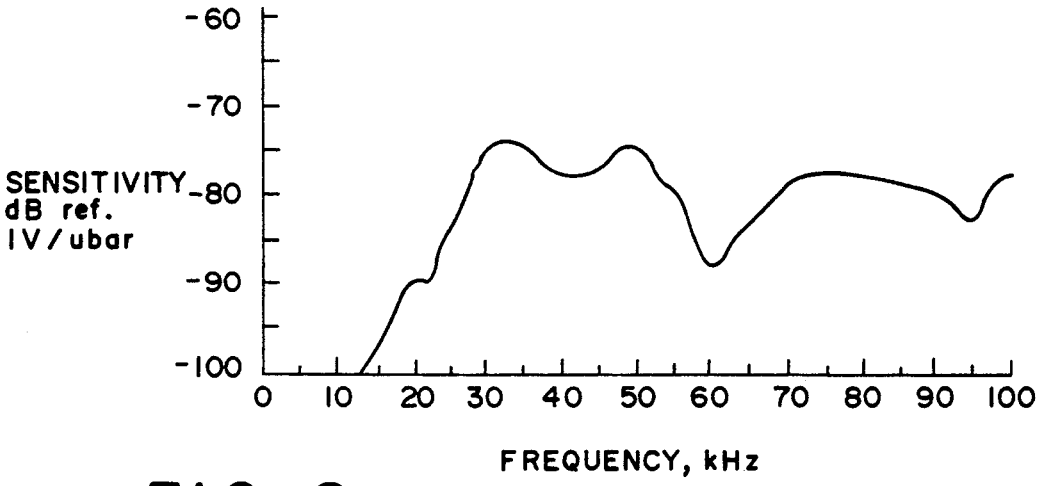
FIG. 2 is a graph which plots the sensitivity of a 32 KHz microphone over sound frequencies ranging from 10 to 100 KHz.

Finally, and most importantly, the control system 1 of the invention includes an acoustical sensor 101 that generates an electrical signal indicative of the intensity of the sound of the flame 15 within the furnace assembly 5. As will be seen hereinafter, the applicant has discovered that the aggregate intensity of all sounds having frequencies over about 10 KHz generated by the flame 15 is directly related to combustion optimality, and may be used to burn fuel with a maximum amount of stoichiometric efficiency and a minimum amount of pollution generation, and in particular minimum $NO_x$ generation. To this end, the acoustic sensor 101 includes a microphone 103 which is advantageously located outside the housing 7 of the furnace assembly 5. In the preferred embodiment, the microphone 103 is a model ALM-CH 8/N 541,542 acoustic emitter that is maximally responsive to sound frequencies of 32 KHz or greater, as is shown in FIG. 2. A wave guide 105 is used to transmit the sounds generated within the envelope of the flame 15 to the microphone 103. In the preferred embodiment, the wave guide 105 is a solid bar of aluminum oxide approximately ½" in diameter and 20" long. Such an aluminum oxide bar is available from Aremco Products, located in Ossining, N.Y. The wave guide is mounted within the walls of the housing 7 by means of guide mounting 106. In the preferred embodiment, the wave guide 105 is slidably movable through a bore in the wave guide mounting 106 so that, during initial set-up, the system operator can easily visually locate the distal end of the wave guide 105 approximately within the center of the envelope of the flame 15. A ring of acoustical dampening material, which may be a heat resistant silicone compound, is included around the wave guide mount 106 to minimize the transmission of spurious sounds from the walls of the furnace housing 7 to the wave guide 105 during operation.

The use of a solid, ceramic material such as aluminum oxide as the wave guide 105 of the acoustical sensor 101 is advantageous in at least three respects. First, applicant has found that use of such a solid bar of ceramic material efficiently and effectively conducts the relatively high frequency sounds of 10 KHz or greater to the microphone 103, thereby allowing the microphone to be placed in the ambient atmosphere away from the corrosive combustibles generated within the furnace housing 7. Secondly, because ceramic materials such as aluminum oxide often are good heat insulators, very little of the heat generated within the envelope of the flame 15 is transmitted to the microphone 103. Thirdly, because ceramic materials are extremely durable in high temperature environments, and do not corrode, the aluminum oxide bar that forms the wave guide 103 is extremely long lived. The electrical output generated by the microphone 103 is connected to a preamplifier 107 whose output is in turn connected to a filter/amplifier 109. In the preferred embodiment, the preamplifier is a model 1220A-S/N 5211,5212 preamp manufactured by Physical Acoustics located in Princeton, N.J., and the filter/amplifier is a model ALM-CH S/N541,542 filter/amplifier also manufactured by Physical Acoustics.

In the first step of the method of the invention, the analyzer probe 99 is detachably mounted within the flue 9 of the furnace housing 7 as indicated. Next, the burner 3 is ignited, and the microvolts generated by the 32 KHz microphone 103 is plotted at preferably between six to eight sample points across the firing range of the burner 3 under optimum combustion conditions. Of course, the number of microvolts generated by the microphone 103 is proportional to the decibels of all sounds generated by the flame 15 in excess of about 10 KHz, with the frequency range of between about 30 and 100 KHz being noted with particular care, as the microphone 103 is most sensitive to these frequencies (see FIG. 2). At the outset, it should be noted that it is the applicant's discovery of a simple, very reliable and near-linear relationship between the intensity of all high frequency sounds generated within the envelope of the flame 15 of the burner 3 and optimum learning conditions that makes the present invention possible. This relationship is illustrated in the family of curves illustrated in FIG. 3. The middle curve that is associated with stoichiometric optimality has two characteristics that contribute to its usefulness in the context of a burner control system. First, as is evident from a comparison of the vertical distances between the stoichiometric curve, the excess air curve and the excess fuel curve, there is at least a 100 microvolt difference between these curves, which makes it easy for the microprocessor controller 43 to resolve optimal vs. non-optimal operating conditions. Second, the stoichiometric curve has broad regions of linearity which allows the microprocessor 43 to accurately interpolate the entire curve from a relatively small number of sample points.

The optimum air and flue gas valve settings for each of the sample points is empirically determined with the help of the analyzer probe 99. To do this, the burner 3 is first ignited. In order to minimize the amount of time it takes to obtain a single optimum sample point at a point within the firing range of the burner 3, the system operator will set the air valve assembly 45 so that the burner 3 initially combusts in an excess air mode. The system operator will then gradually close the air valve assembly 45 until the analyzer probe 99 indicates that minimum free $O_2$ and minimum free CO are being generated by the burner 3, which indicates that stoichiometric burning has been achieved. Next, the blower 37 of the recirculating flue gas source 35 is activated, and the flue gas valve assembly 83 gradually opened from an initially closed position while the system operator monitors the amount of $NO_x$ generated by the flame 15 of the burner 3. After the minimum $NO_x$ generation has been achieved for the particular point on the firing range that the fuel valve assembly 60 has been set (which may be determined by comparing the $NO_x$ level achieved with minimum $NO_x$ generation specifications supplied by the manufacturer of the burner 3), the position of the air valve assembly 45 and recirculating flue gas valve assembly 83 is noted and entered into the memory of the microprocessor controller 43, along with the associated microvolt output of the microphone 103. The $NO_x$ minimization step tends to drop the optimized curve (shown with a dashed line) downwardly from the stoichiometric curve into the position illustrated in FIG. 3, as minimized $NO_x$ generation tends to lower the total amount of high frequency sounds generated by the burner 3.

After the system operator has entered between six and eight sample points into the memory of the microprocessor controller 43 (which points are preferably uniformly distributed across the entire firing range of the burner 3), the interpolation software of the microprocessor controller 43 is actuated to plot a complete curve of optimum valve assembly positions for the fuel valve 60, air valve 45 and flue gas valve 35 for each point along the firing range of the burner 3.

The analyzer probe 99 is then removed from the flue 9 of the furnace housing 7, and the microprocessor 43 actuated. All during the operation of the combustion burner 3, the microprocessor 43 constantly monitors the voltage generated by the microphone 103 (which is, of course, directly indicative of the aggregate level of sounds having frequencies over about 12 KHz generated within the envelope of the flame 15), and constantly adjusts the air control, fuel control and flue gas control valve assemblies 45, 58 and 83 in order to maintain optimality at all points along the firing rate of the burner 3, which firing rate varies in response to the heat demand that the furnace assembly 5 is subjected to.

FIG. 4 is a schematic diagram of a manually operated alternate embodiment of the control system 1 of the invention. In this embodiment, the output of the filter/amplifier 109 is electrically connected to a monitoring mechanism 110 that monitors the output of the sound intensity detected by the acoustical sensor 101 so that it can be compared to empirically-derived sound intensities associated with optimality. To this end, the output of the monitoring mechanism is connected to a chart recorder 112 that records the sound intensities detected by the sensor 101 over time. This embodiment preferably also includes a comparator circuit 114 for continuously and automatically comparing the detected sound intensities with the optimal sound intensities, and an alarm circuit 115 for informing the system operator when the air and fuel valve assemblies 45 and 58 and flue gas control valve assembly 83 are in need of readjustment.

While the invention has been described in the context of a control system 1 for a natural gas burner 3 used to heat a steam boiler, it will be evident to persons skilled in the art that the invention is applicable to any type of furnace having a flame generating burner, and all such applications are considered to be within the scope of this invention. Such applications may include, for example, furnaces used in steel and aluminum plants, glass melters, aggregate rotary dryers, ladel heating stations, and others. It will also be evident that the advantageous results of the invention can be obtained through structures equivalent in function to those described herein, and all such equivalent uses and structures are also deemed to be within the ambit of the instant invention.

We claim:

1. A method for optimally controlling a burner control system that includes an air valve assembly and a fuel valve assembly for modulating air and fuel to a flame producing combustion burner over a range of firing rates, comprising the steps of:

monitoring the level of sound intensity of all sounds produced by the combustion flame of the burner by a microphone means acoustically coupled to the flame by an acoustical waveguide having a distal end disposed within the envelope of said combustion flame, and maintaining the level of the aggregate sound intensity of all sounds produced by the combustion flame of the burner that have an acoustical frequency above 10 Khz at a pre-selected level associated with optimality by adjusting said air and fuel valve assemblies.

2. A burner control method as defined in claim 1, further including the step of obtaining, for each point along said range of firing rates, the sound intensity level associated with optimality by measuring the level of the sound intensity of said sounds while simultaneously measuring the amount of oxygen present in the combustion products of said flame associated with different settings of said air and fuel valve assemblies.

3. A burner control method as defined in claim 2, wherein the amount of pollutants present in the combustion products of said flame is also measured.

4. A burner control method as defined in claim 1, wherein the level of the sounds equated have an acoustical frequency above 20 Khz.

5. A burner control method as defined in claim 1, wherein the level of sounds equated have an acoustical frequency above 30 Khz.

6. A burner control method as defined in claim 1, wherein the level of sound intensity of all sounds produced by the combustion flame of the burner is measured by a microphone means having a bandwidth that includes only those acoustical frequencies that are over 10 Khz.

7. An acoustically operated burner control system for optimally controlling a flow of air and fuel into a flame-producing combustion burner throughout a range of firing rates, comprising:

first and second valve assemblies for modulating the flow of air and fuel into the burner;

a microphone means for generating an electrical signal indicative of the aggregate intensity of all sounds generated by said combustion flame that are above 1 Khz in frequency, an acoustical waveguide for acoustically coupling said microphone means to said flame and isolating the microphone means from the heat generated by the flame, and a controller operatively connected to the first and second valve assemblies and electrically connected to said microphone means for maintaining the aggregate sound intensity of all sounds generated by said combustion flame that are above 1 Khz in frequency at a pre-selected level associated with optimality at each point within said range of burner firing rates.

8. An acoustically operated burner control system for optimally controlling a flow of air and fuel into a flame-producing combustion burner throughout a range of firing rates, comprising:

first and second valve assemblies for modulating the flow of air and fuel into the burner;

a microphone means for generating an electrical signal indicative of the aggregate intensity of all sounds generated by said combustion flame that are above 1 Khz in frequency;

an acoustical waveguide having a distal end disposed within the envelope of said combustion flame for acoustically coupling said microphone means to said flame and isolating the microphone means from the heat generated by the flame, and a controller operatively connected to the first and second valve assemblies and electrically connected to said microphone means for maintaining the aggregate sound intensity of all sounds generated by said combustion flame that are above 1 Khz in frequency at a pre-selected level associated with optimality at each point within said range of burner firing rates.

9. An acoustically operated burner control system as defined in claim 8, wherein the bandwidth of said microphone means includes only acoustical frequencies greater than 5 Khz.

10. An acoustically operated burner control system as defined in claim 8, wherein the bandwidth of said microphone means includes only acoustical frequencies greater than 10 Khz.

11. An acoustically operated burner control system as defined in claim 8, wherein the bandwidth of said microphone means includes only acoustical frequencies greater than 20 Khz.

12. An acoustically operated burner control system as defined in claim 8, wherein the bandwidth of said microphone means includes only acoustical frequencies greater than 30 Khz.

13. An acoustically operated burner control system as defined in claim 8, wherein said valve means are each electrically controlled, and wherein said controller is electrically connected to each of said valves.

14. An acoustically operated burner control system as defined in claim 8, wherein said burner is enclosed in a furnace housing, and said microphone means is located outside of said housing, and said acoustical waveguide further functions to isolate the microphone means from the combustion products generated by the flame.

15. An acoustically operated burner control system as defined in claim 8, wherein said controller includes a microprocessor having a memory, and wherein said preselected sound levels are entered into the memory of the microprocessor.

16. An acoustically operated burner control system as defined in claim 8, further comprising a probe means for determining the aggregate sound intensities associated with optimality by measuring the amount of oxygen present in the combustion products of said flame at different settings of said first and second valve means.

17. An acoustically operated burner control system for optimally controlling a flow of air and fuel into a flame producing combustion burner throughout a range of firing rates, comprising:

first and second electrically operated valve assemblies for modulating the flow of air and fuel into the burner;

a microphone means of generating an electrical signal indicative of the aggregate intensity of all sounds generated by said combustion flame having a frequency above 10 Khz;

a solid acoustical waveguide having a distal end disposed within the envelope of said combustion flame for acoustically coupling said microphone means directly to the envelope of said flame and isolating the microphone means from the heat generated by the flame;

a probe means for establishing the aggregate sound intensity associated with an optimal flow of air and fuel into the burner for each point throughout the firing range of the burner, and a controller including a microprocessor having a memory for storing each of said sound levels associated with optimality, an output electrically connected to said first and second valve assemblies; and an input electrically connected to said microphone means, wherein said controller maintains the aggregate sound intensity of all sounds having a frequency above 10 Khz that are associated with optimality at each point along said firing range of said burner by modulating said valve assemblies to equate the sound intensity sensed by said microphone means with the sound intensity entered into said microprocessor memory, and wherein each level of optimality is associated with an aggregate sound intensity which is less than the sound intensity associated with an excess air condition but greater than the sound intensity associated with an excess fuel condition.

18. An acoustically operated burner control system as defined in claim 17, wherein the bandwidth of said microphone means includes only acoustical frequencies greater than 20 Khz.

19. An acoustically operated burner control system as defined in claim 17, wherein the bandwidth of said microphone means includes only acoustical frequencies greater than 30 Khz.

20. An acoustically operated burner control system as defined in claim 17, wherein said burner is enclosed in a furnace housing, and said microphone means is located outside of said housing, and said acoustical waveguide further functions to isolate the microphone means from the combustion products generated by the flame.

21. An acoustically operated burner control system for optimally controlling a flow of air and fuel into a flame producing combustion burner, comprising:

a microphone means for generating an electrical signal indicative of the aggregate intensity of the sound generated by said combustion flame above 10 Khz in frequency;

a solid acoustical waveguide for acoustically coupling said microphone means to said flame and isolating the microphone means from the heat generated by the flame, and a monitoring means electrically connected to the output of the microphone means for recording the aggregate sound intensity above 10 Khz generated by said combustion flame so that said aggregate sound intensity may be compared to a pre-selected sound intensity above 10 Khz in frequency associated with optimality.

22. An acoustically operated burner control system as defined in claim 21, further comprising a means for comparing the aggregate sound intensity detected by the microphone means, and the pre-selected sound intensity above 10 Khz in frequency, and for generating an alarm signal when said sound intensities are not substantially equal.

23. An acoustically operated burner control system as defined in claim 21, wherein the bandwidth of said microphone means includes only acoustical frequencies greater than 20 Khz.

24. An acoustically operated burner control system as defined in claim 21, wherein the bandwidth of the microphone means includes only acoustical frequencies greater than 30 Khz.

25. A method for optimally controlling a burner control system that includes an air valve assembly and a fuel valve assembly for modulating air and fuel to a flame producing combustion burner over a range of firing rates, comprising the steps of:

monitoring the level sound intensity of all sounds produced by the combustion flame of the burner by a microphone means acoustically coupled to the flame by a solid acoustical waveguide having a distal end disposed within the envelope of said combustion flame;

obtaining, for a plurality of points long said range of firing rates, the sound intensity level associated with stoichiometric optimality by measuring the level of intensity of all sounds having frequencies of over 10 Khz generated by said combustion flame when said burner is burning air and fuel at a stoichiometric ratio at said points along said firing rate;

interpolating and recording a sound level for each point along the firing range of said burner that is associated with optimality;

operating said burner at a selected point along said firing range, and maintaining the sound intensity level of all sounds generated by the combustion flame having acoustical frequencies of over 10 Khz at the optimal sound level associated with said selected point along said firing range by adjusting said valve assemblies.

26. An acoustically operated burner monitoring system for optimally sensing optimal burning conditions in a flame producing combustion burner, comprising:

a microphone means for generating an electrical signal indicative of the aggregate intensity of the sound generated by said combustion flame above 10 Khz in frequency, an acoustical waveguide having a distal end disposed within the envelope of said combustion flame for acoustically coupling said microphone means to said flame and isolating the microphone means from the heat generated by the flame, and a monitoring means electrically connected to the output of the microphone means for recording the aggregate sound intensity above 10 Khz generated by said combustion flame so that said aggregate sound intensity may be compared to a pre-selected sound intensity above 10 Khz in frequency associated with the minimum generation of pollutants, and record the burner performance for pollutants, and alarm when pollutants are above a prescribed threshold.

27. An acoustically operated burner monitoring system as defined in claim 26, further comprising a means for comparing the aggregate sound intensity detected by the microphone means, and the pre-selected sound intensity above 10 Khz in frequency, and for generating an alarm signal when said sound intensities are not substantially equal.

28. An acoustically operated burner monitoring system as defined in claim 26, wherein the bandwidth of said microphone means includes only acoustical frequencies greater than 20 Khz.

29. An acoustically operated burner monitoring system as defined in claim 26, wherein the bandwidth of the microphone means includes only acoustical frequencies greater than 30 Khz.

30. An acoustically operated burner monitoring system as defined in claim 26, further comprising first and second manually operated valve assemblies for modulating the flow of air and fuel into the burner.

* * * * *